United States Patent [19]

Duhé

[11] 4,277,894

[45] Jul. 14, 1981

[54] PIPE JOINT INTERSECTION CONTOUR SCRIBER

[76] Inventor: Lance B. Duhé, Box 753 K - 171 E. 17th St., Reserve, La. 70084

[21] Appl. No.: 22,856

[22] Filed: Mar. 22, 1979

[51] Int. Cl.[3] ..... B43L 13/10

[52] U.S. Cl. ..... 33/21 C

[58] Field of Search ..... 33/21 C; 266/58, 64, 266/56

[56] References Cited

U.S. PATENT DOCUMENTS

| | | | |
|---|---|---|---|
| 2,389,286 | 11/1945 | Watkins | 33/21 C |
| 2,408,517 | 10/1946 | Howard | 33/21 C |
| 2,460,412 | 2/1949 | Douglass | 33/21 C |
| 3,442,500 | 5/1969 | Fall | 33/21 C |

*Primary Examiner*—Harry N. Haroian

*Attorney, Agent, or Firm*—C. Emmett Pugh & Associates

[57] ABSTRACT

A novel pipe joint intersection contour scriber is disclosed for use in the art of welding pipes together at intersections which may or may not be perpendicular. The invention consists of a template connected by two rods to a three-disc assembly, one disc of which has a scriber sub-assembly. The three-disc assembly provides an adjustable clamp and centering function with the disc closest to the template containing the scriber sub-assembly which is allowed to rotate through 360°. The scriber pen is connected by way of a sleeve to a wheel which rotates on the template causing the pen to trace the appropriate line. The scriber and wheel assembly is attached to the rotating disc by means of an adjustable three-piece section which functions to provide a means for adjusting the distance of the scriber pen from the center of its path of rotation and operates on the principal of a parallelogram, always maintaining the pen in the same orientation.

10 Claims, 8 Drawing Figures

PIPE JOINT INTERSECTION CONTOUR SCRIBER

BACKGROUND OF THE INVENTION

This invention relates to pipe scribers and more particularly to a novel pipe joint intersection contour scriber for use in the art of welding pipes together at intersections which may or may not be perpendicular.

In the art of welding pipes together at intersections which may or may not be perpendicular, the end of a branch pipe at such an intersection will define a rather complex curve, and it is necessary to scribe this curve with an appropriate portable tool so that the pipe may be cut at the appropriate place and welded to the mating pipe so that the intersection is even with the pipe to which it will be connected.

It is known in prior art devices to provide such portable tools for accomplishing the scribing and/or cutting and such prior art devices are disclosed in a number of patents uncovered as a result of a prior art search. The patents uncovered are the U.S. Pat. Nos. 2,389,286; 2,545,666; 2,726,450; 2,852,847; 2,859,522; 3,464,685; 1,858,076; 2,878,010; and 3,442,500.

Of particular interest to the applicant's invention are the above patents herein discussed below as follows:

1. U.S. Pat. No. 2,545,666 issued to H. E. Lonngren and entitled "Pipe Intersection Bevel Cutting Device" discloses a device having a flame cutter or torch 19 rigidly connected to a rotatable guide assembly so that it may be rotated completely around a branch pipe. The path of the torch is diverted longitudinally as it turns by wheel 26 rolling along a cylindrical template 24 which has the same diameter as the main pipe 8 to which the branch pipe is to be connected. A second torch 18 is likewise guided by the same mechanism to cut the corresponding hole in main pipe 8 for accurate mating of the two pipes. This patent is apparently utilized only on "T" branch connections and requires a centering plate 32 and collars 33 to match the outside diameter of each branch pipe used. In addition this device requires contoured template elements 24 for each size of branch and in the event the device is not restricted to "T" connections, a template contoured for each desired angle of intersection would be needed for each size of branch pipe. The cylindrical template 24 also becomes cumbersome when mating a 4" pipe branch to a vessel having a diameter of 36" for example.

2. U.S. Pat. No. 2,878,010, issued to A. Cink and entitled, "Hand Apparatus for Flame Cutting of Profiled Tube Ends" operates in a similar manner to that of the above-mentioned Lonngren patent although it has a somewhat different configuration. The internal mounting utilized in this device is branch size range limiting and is not specific as to adjustability of one template with respect to inclination. There appears to be no means of determining the angle of inclination of one template without the need for others.

3. U.S. Pat. No. 2,852,847, issued to C. H. Cast and entitled, "Pipe Intersection Delineating Apparatus" teaches the use of a variable sleeve 30 on which a scribe is mounted so as to rotate about a pivot pin 2 and mark the proper cut line for a pipe intersection. The displacement of the scribe relative to the pivot corresponds to the radius of the main pipe. The orientation of bracket 21 corresponds to the angle of intersection. This device does not delineate mitered intersections and requires a shifting of the scribe-pointer bracket to obtain a complete delineation of a pipe intersection. In addition it requires sleeves and/or shims to accommodate mounting of the apparatus to different size branches.

4. U.S. Pat. No. 2,859,522, issued to C. M. Thomas and entitled, "Pipe Marker" discloses a device with a principal of operation similar to that of the before-mentioned Cast patent but requires a repositioning of the apparatus to complete delineation and further requires a determination of a center line on the branch pipe with the unit being not self-centering. The device shown in this patent would probably be cumbersome and inaccurate when used with smaller branch pipes and does not delineate mitered intersections.

5. U.S. Pat. No. 2,389,286, issued to W. W. Watkins and entitled "Apparatus for Marking or Cutting Pipes" discloses a device for cutting or marking pipes to be joined at their ends and has a cutter or marker which is guided along the pipe in a plane which may be oblique with respect to the pipe end. This device is not self-centering and makes only mitre cuts of delineations and the chocks on the end of the pipe waste a portion of the work piece.

The remaining patents before mentioned are not felt to be particularly pertinent and have been listed for general information concerning the level of development in the general arts area.

SUMMARY OF THE INVENTION

In order to overcome the problems inherent in the prior art devices there has been provided by the subject invention a new and novel pipe joint intersection contour scriber which may be used in the art of welding pipes together at intersections which may or may not be perpendicular. The end of a branch pipe at such an intersection will define a rather complex curve and the applicant's invention provides a portable tool which may be attached to such a branch pipe and which will scribe on the pipe a line corresponding to the curve the pipe will need in order to intersect evenly with the pipe to which it will be connected. The invention consists of a replaceable and adjustable template unit connected by a plurality of rods to a three-disc assembly comprising a centrally located plate positioned between a first and second rotatable gear unit. The second rotatable gear unit contains a scriber unit sub-assembly and the three-disc assembly of the applicant's invention provides an adjustable clamp and centering function. The second rotatable gear unit contains the scriber sub-assembly which is allowed to rotate through 360° with the scriber pen being connected by way of a sleeve to a circular follower disc or wheel which rotates on the template causing the pen to trace the appropriate line on the pipe.

The scriber and wheel assembly is attached to the second rotatable gear unit by means of an adjustable three-piece section which functions to provide a means for adjusting the distance of the scriber pen from the center of its path of rotation to operate on the principal of a parallelogram always maintaining the pen in the same orientation.

Accordingly it is an object and advantage of the invention to provide a simple pipe joint intersection contour scriber containing novel linkage features which always keep the scriber pointing to the center of the pipe being scribed and having a rotating wheel always traveling on a tangent.

Yet another object and advantage of the invention is to provide a new and novel pipe joint intersection countour scriber containing minimal numbers of parts and which may be quickly and easily set up in the field in order to accomplish the object desired by the scriber.

These and other objects and advantages of the invention will become apparent from a review of the drawings of the invention and from a description of the embodiment hereinafter described.

DESCRIPTION OF ONE EMBODIMENT

Figures 1, 2, 3, 4, 5:
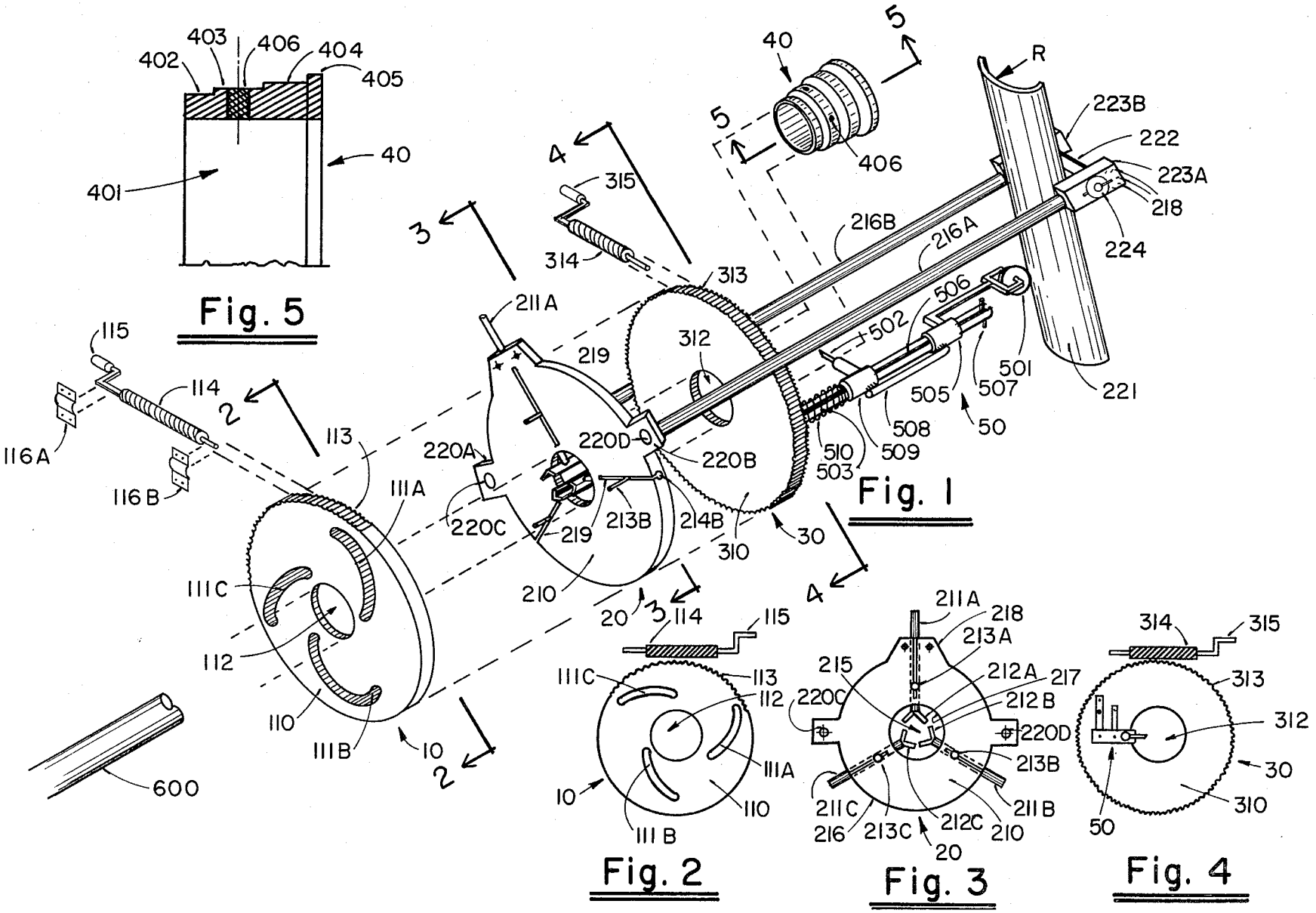
FIG. 1 is an exploded perspective view of the applicant's new and novel pipe joint intersection contour scriber.
FIG. 2 is a view taken along line 2—2 of FIG. 1 showing the first rotatable gear unit of the applicant's invention.
FIG. 3 is a view taken along line 3—3 of FIG. 1 showing the circular plate of the applicant's invention.
FIG. 4 is a view taken along line 4—4 of FIG. 1 showing the second rotatable gear unit of the applicant's invention.
FIG. 5 is a sectional view taken along line 5—5 of FIG. 1 showing in detail the collar unit of the applicant's invention which is positioned through the central holes on the circular plate and the first and second rotatable gear units.

Referring now to the drawings in general and in particular to FIG. 1 of the drawing there is shown an exploded perspective view of the applicant's new and novel pipe joint intersection contour scriber which comprises a three-disc assembly comprising a first rotatable gear unit shown generally by the numeral 10 and a circular plate shown generally by the numeral 20. Positioned against the circular plate 20 is a second rotatable gear unit shown generally by the numeral 30 forming the third disc of the three-disc assembly. The three discs 10, 20 and 30 are held in an adjacent relationship by means of a collar unit shown generally by the numeral 40 which is positioned between central holes contained in the three-disc assembly. The central hole in the first rotatable gear unit 10 is shown generally by the numeral 112 while the central hole in the central plate 20 is shown generally by the numeral 215 and in a like manner the central hole in the second rotatable gear unit 30 is shown generally by the numeral 312.

By referring to FIG. 5 of the drawing in conjunction with FIG. 1 it can be seen how the collar 40 is formed in such a manner as to be able to be positioned between the three central holes 112, 215 and 312 of the three-disc assembly. The collar 40 is formed with a central hole shown generally by the numeral 401 and has an external flange 405 on one end thereof with outer diameter surfaces 402, 403 and 404 matching the inner diameter of the respective central holes 112, 215 and 312 through which that portion of the collar unit 40 is contained. In addition the collar unit 40 also contains a radially drilled hole shown generally by the numeral 406 initiating at the outer diameter surface 403 and terminating at the inner surface of the hole 401. The function of the radially drilled hole 406 and several similarly drilled and placed holes will be described more fully hereinafter when referring to the circular plate 20.

Referring now back to FIG. 1 of the drawing in conjunction with FIGS. 2 and 3 it can be seen that the first rotatable gear unit 10 comprises a circular disc 110 having formed on the outer periphery thereof a gear tooth 113 of the type and size to mate with a matching worm gear 114 which is positioned on a frame not shown in the drawing. The worm gear 114 is mounted for rotation by means of the handle 115 and is rotatably carried by the bracket 116A and 116B. The gear tooth 113 comprises therefore a worm gear and the worm screw 114 acts to rotate the first rotatable gear unit 10 whenever the handle 115 is rotated.

There is also contained in the central portion of the first rotatable gear unit 10 a plurality of internal cam surfaces 111A, 111B and 111C whose function will be described more fully hereinafter. Referring now to FIG. 1 again but in particular plate 20 as has been before mentioned, the circular plate 20 would comprise a circular disc 210 having formed in the central portion thereof the central hole 215 and also having formed radially therein from the outer surface 216 a plurality of radially drilled holes 214B which initiate at the outer surface 216 and terminate at the inner surface 217 of the hole 215. In addition there is also formed a third hole 214B which is formed approximately 120° apart from the first two holes 214B and which initiates at an extended flange 218 contained on the outer surface 216 of the disc 210.

It can also be seen by referring to FIG. 1 of the drawing that the holes 214 also have cut therein a radially positioned slot 219. The holes 214B contain a plurality of movable rods 211A, 211B and 211C which have fixedly attached thereto a protruding cam follower 213A, 213B and 213C. The movable rods 211A, 211B and 211C also have positioned on the end thereof a plurality of angular brackets 212A, 212B and 212C which are designed to position over the pipe to be cut and to firmly hold the pipe joint intersection contour scriber fixedly attached to that pipe. This is accomplished by means of the positioning of the cam followers 213A, 213B and 213C within the internal cam surfaces 111A, 111B and 111C. It can be seen then that a rotation of the worm screw 114 by means of the handle 115 will rotate the circular disc 110 forming the first rotatable gear unit in such a manner as to drive the cam followers 213A, 213B and 213C to either a tightening or loosening position around the pipe to be cut which would be inserted within the central holes 112, 215 and 312.

It can also be seen now that whenever the collar unit 40 is inserted into the second rotatable gear unit 30 and the circular plate 20 as well as the first rotatable gear unit 10, that the movable rods 211A, 211B and 211C would be positioned within the before mentioned radially drilled holes 406 contained in the collar unit 40.

Referring now again to FIG. 1 of the drawing and more specifically to the second rotatable gear unit 30 it will be noted that this disc comprises a circular shaped disc 310 having formed on the periphery thereof a gear tooth 313 designed for mating engagement with a worm screw 314 which is rotated by means of the handle 315. It should be noted at this point that the worm screw 314 would also be rotatably attached to a frame not shown in the drawings by means of a plurality of brackets similar to the brackets 116A and 116B utilized with the first rotatable gear unit 10. For purposes of clarity these brackets have been omitted from the worm screw 314.

The second rotatable gear unit also has attached thereto a scriber unit sub-assembly 50 which is shown in more detail in FIG. 6 of the drawing and will be described only briefly when referring to FIGS. 1 and 4 of the drawing at the present time. The scriber unit sub-assembly 50 contains a circular follower disc 501 which is designed for moving over a template 221 which is positioned and adjustably mounted between two parallel rods 216A and 216B fixedly attached to the circular plate 20 at the extended flanges 220A and 220B as shown in FIG. 1 of the drawing. The rods 216A and 216B would be rigidly held in the flanges 220A and 220B by means of the drilled and tapped holes 220C and 220D.

Figure 7:
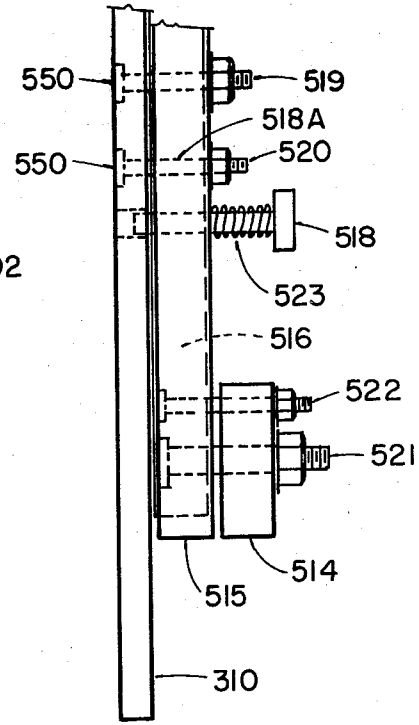
FIG. 7 is a side view taken along 7—7 of FIG. 6 showing the plurality of movable arms rotatably attached to the second rotatable gear unit.
Figure 8:
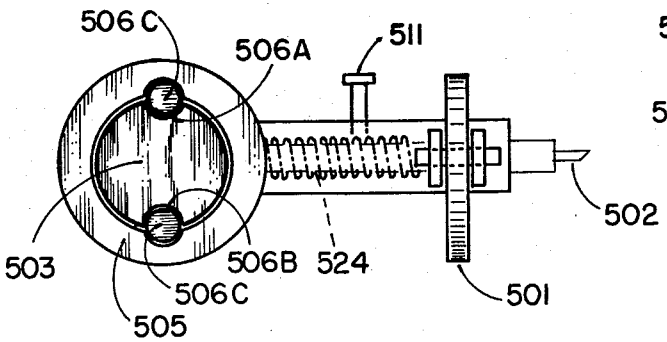
FIG. 8 is a side view taken along line 8—8 of FIG. 6 showing the circular follower disc for moving over the template and the scriber point for scribing the pipe.

The operation of the scriber unit sub-assembly 50 will be described more fully hereinafter when referring to FIGS. 6, 7 and 8 of the drawing. However it should be noted at this time that the scriber unit sub-assembly also contains a scriber point 502 for scribing the pipe to be eventually cut that is positioned within contour scriber of the invention. The template 221 is removably attached between the rods 216A and 216B and is held in place therebetween by means of the rods 222 positioned between the number 223A and 223B. The rod 220 is positioned within the members 223A and 223B so as to be able to be rotatable to a desired degree of rotation as shown by the angled dial indicator 224 thereby allowing the template 221 to be rotated to a desired angled degree corresponding to the intercepting pipe which the branch pipe would be welded to.

In addition it can be seen that the template 221 would be replaceable with a different sized template having a different radius R as shown in FIG. 1 and the follower disc 501 would thereby be able to move over the template 221 of the given size and angled position to scribe the intersecting pipe by means of the scriber point 502. Referring now particularly to FIGS. 6, 7 and 8 of the drawing there will be shown in more detail the new and novel features of the applicant's invention of the scriber unit sub-assembly 50 which is shown also in FIGS. 1 and 4 of the drawing. The scriber unit sub-assembly comprises in part a plurality of movable arms 515 and 516 which are rotatably attached to the second rotatable gear unit 30 which is formed from the disc 310 having the gear tooth 313 contained on the outer periphery as before mentioned. The movable arm 515 is rotatably mounted on the disc 310 by means of the bolt and nut 519 while the movable arm 516 is movably mounted on the disc 310 by means of the bolt and nut 520. In FIG. 6 of the drawing for purposes of clarity it can be seen that the bolt and nut 520 is shown in the unassembled position and the bolt and nut 519 is shown in the assembled position. By referring to FIG. 7 it can be seen that the heads of the bolts utilized in the bolt and nut combination 519 and 520 are positioned within a drilled and countersunk hole 550 contained in the disc 310.

The second rotatable gear unit 30 also has formed therein a plurality of holes 517A, 517B, 517C, 517D, 517E, 517F and, 517G in which are positioned in a semi-circular manner below the bolt and nut combination 519 and are designed for mating engagement with a movable stop member 518 which is positioned within a hole 518A drilled in the movable arm 515. It can be seen that the movable stop member 518 would be spring-biased as shown generally by the numeral 523 when referring to FIG. 7 of the drawing. It can also be seen in FIG. 7 of the drawing how the movable stop member 518 is positioned within one of the holes 517A-G. The purpose of this adjustment to the movable arm 515 is to be able to set the scriber point 502 for different sizes of pipe to be scribed and to be carried by the contour scriber unit.

Figure 6:
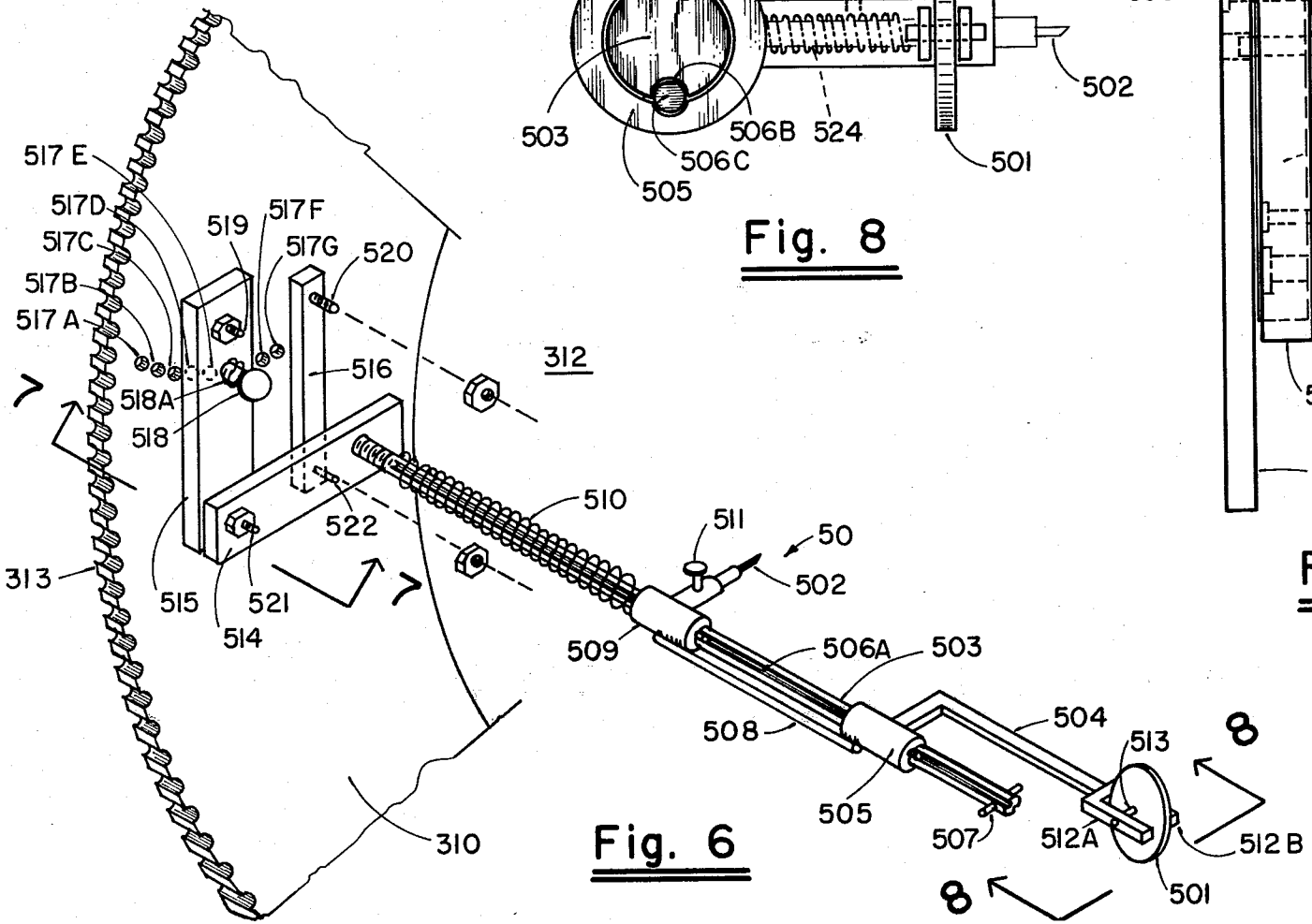
FIG. 6 is an enlarged section of the scriber unit subassembly of the applicant's invention showing it attached to the second rotatable gear unit and looking in the direction shown by the arrows 4—4 of FIG. 1 of the drawing.

Movably attached on the bottom portion of the movable arms 515 and 516 is another movable arm 514 as shown in FIG. 6 of the drawing and is movably attached thereto by means of the bolt and nut combination 521 and 522. By referring to FIG. 6 it can be seen that the bolt and nut combination 522 has been shown as being disassembled while the bolt and nut combination 521 has been shown being assembled. Also attached to the movable arm 514 is an elongated rod 503 which is threaded on one end and is screwed into the movable arm 514 as shown in FIG. 6 of the drawing. The elongated rod 503 also carries the circular follower disc 501 before mentioned and the scriber point 502 as will be described more fully at this time.

The circular follower disc 501 and the scriber point 502 are fixedly attached together and are movable along the elongated rod 503 by means of a plurality of cylindrical members 505 and 509 which surround the elongated rod 503 and are designed to slide thereon being held in an accurately alligned position by means of an elongated semicircular raceway 506A and 506B formed in the upper and lower portions of the elongated rod 503. Positioned in the raceway 506A and 506B are a plurality of ball bearings 506C. In addition it can be seen by referring to FIG. 6 that the cylindrical members 505 and 509 are fixedly attached together by means of the elongated rod 508 which is welded to the circular members 505 and 509. There is also formed in one end of the elongated rod 503 a stop 507 which is designed to stop the cylindrical members 505 and 509 whenever they are moved along the elongated rod 503. It should also be noted that the circular follower disc 501 and the scriber point 502 are spring-biased by means of a coil spring 510 which is positioned around the outer surface 524 of the elongated rod 503 and is grounded at one end thereof against the movable arm 514 and at the other end thereof against the cylindrical member 509.

The cylindrical member 509 also contains an adjustable screw 511 which is used to allow the scriber point 502 to be replaced in the cylindrical member 509 whenever the scriber point becomes dull from use in scribing a pipe. The follower disc 501 is rotatably mounted by means of a pin 513 positioned between a pair of arms 512A and 512B which are in turn carried by an elongated arm 504 fixedly attached to the cylindrical member 505.

In operation, the pipe joint intersection countour scriber would have a pipe 600 positioned through the central holes 112, 215 and 312 as before described and would have the contour scriber rigidly held to the pipe 600 by means of the brackets 212A, 212B and 212C which would be tightened on the pipe 600 by means of the worm screw 114 and the handle 115.

Thereafter the appropriate size template 221 which would correspond to the size of the pipe to which the pipe 600 would be welded, would be inserted between the rods 216A and 216B and would be adjusted at a given angle as shown on the dial indicator 224 corresponding to the main pipe to which the pipe 600 would be welded. Thereafter the plurality of movable arms 514, 515 and 516 would be positioned by utilizing the movable stop member 518 and inserting it in one of the holes 517A-G so that the scriber point 502 would be positioned against the pipe 600. Thereafter it can be seen that the follower disc 501 would then move up and down the surface of the template 221 whenever the second rotatable gear unit 30 was rotated by means of the worm screw 314 and the handle 315 to scribe the pipe 600 by means of the scriber point 502. Thereafter the pipe 600 would be removed from the pipe joint intersection contour scriber and would be cut to the appropriate scribed contour by means of the welding torch and would ultimately be welded to the main pipe corresponding to the template 221 inserted in the contour scriber.

From the above it can be seen there has been provided a novel pipe joint intersection contour scriber comprising a simple three-disc assembly wherein a first and second rotatable gear units are positioned on either side of a circular plate with the circular plate carrying an adjustable template unit and also with the second rotatable gear unit carrying the scriber unit sub-assembly. The scriber unit sub-assembly may be rotated through 360° by means of the second positioning means and the first rotatable unit may be positioned approximately 120° by means of the first positioning means in the form of the adjustable worm screw unit. The scriber point functions to provide a means to scribe the path on the pipe to be cut from the center of its path of rotation and operates on the principal of a parallelogram always maintaining the scriber pen or scriber point in the same orientation as the second rotatable gear unit is rotated with the follower disc moving on the template.

It is noted that instead of using the invention as a classical "scribber," that is one which uses a marking instrument to mark a path on a pipe, a cutting torch could be substituted for the scriber point 502 and the invention used to actually cut a path rather than just mark a path. Also, for example, the circular follower disc or wheel 501 could be driven so that the scribing system is powered and moves automatically without manual intervention. Also, for example the circular follower disc or wheel 501 could be driven so that the scribing system is powered and moves automatically without manual intervention. This is of course merely exemplary of the many possible changes.

As changes may be made in the various parts of the invention without departing from the spirit and scope of the invention, it should be noted that the invention is not to be limited to the exact parts described which have been given by way of illustration only.

Having described my invention, I claim:

1. A pipe joint intersection contour scriber comprising:

(a) a replaceable and adjustable template unit;

(b) a circular plate fixedly attached to the template unit and having a central hole formed therein and further having clamping means positioned within the hole and carried by the circular plate for clamping to the pipe to be scribed;

(c) a first rotatable gear unit having a central hole formed therein through which the pipe to be scribed is positioned; the unit being connected to and positioned on one side of the circular plate and having first means associated therewith for rotatably positioning the first gear unit and the circular plate at a desired position;

(d) a second rotatable gear unit having a central hole formed therein through which the pipe to be scribed is positioned; the unit being positioned on the other side of the circular plate and having second means associated therewith for rotatably positioning the second gear unit;

(e) a collar unit positioned over the pipe to be scribed and through the central holes on the circular plate and the first and second gear units; and (f) a scriber unit movably attached to the second gear unit and having a circular follower disc thereon for moving over the template and further having a scriber point for scribing the pipe.

2. The pipe joint scriber as defined in claim 1 wherein the clamping means positioned within the central hole formed in the circular plate comprises a plurality of angular brackets fixedly attached to movable rods, each rod having formed thereon a protruding cam follower.

3. The pipe joint scriber as defined in claim 2 wherein the first rotatable gear unit positioning means comprises in part a plurality of internal cam surfaces formed in the gear unit and sized to accommodate the protruding cam followers formed on the movable rods.

4. The pipe joint scriber as defined in claim 3 wherein the first rotatable gear unit has formed on the periphery thereof a worm gear and the gear unit positioning means comprises in part a worm screw in mating engagement with the worm gear.

5. The pipe joint scriber as defined in claim 1 wherein the second rotatable gear unit has formed on the periphery a worm gear and the gear unit positioning means comprises a worm screw in mating engagement with the worm gear.

6. The pipe joint scriber as defined in claim 1 wherein the scriber unit comprises in part a plurality of movable arms rotatably attached to the second rotatable gear unit.

7. The pipe joint scriber unit as defined in claim 6 further comprising the second rotatable gear unit having formed therein a plurality of holes and further having formed on the movable arms a movable stop member for insertion into one of the plurality of holes.

8. The pipe joint scriber unit as defined in claim 6 wherein the scriber unit comprises in part an elongated rod positioned in one of the movable arms for carrying the circular follower disc and the scriber point thereon.

9. The pipe joint scriber unit as defined in claim 8 wherein the circular follower disc and the scriber point are fixedly attached together and are movable along the elongated rod.

10. The pipe joint scriber unit as defined in claim 9 wherein the circular follower disc and the scriber point are spring-biased by means of a coil spring positioned between one of the movable arms and the scriber point.

* * * * *